United States Patent [19]

Kountz

[11] 4,236,669

[45] Dec. 2, 1980

[54] THERMOSTATIC EXPANSION VALVE WITH LEAD-LAG COMPENSATION

[75] Inventor: Kenneth J. Kountz, Hoffman Estates, Ill.

[73] Assignee: Borg-Warner Corporation, Chicago, Ill.

[21] Appl. No.: 970,847

[22] Filed: Dec. 18, 1978

[51] Int. Cl.[3] ..... G05D 27/00

[52] U.S. Cl. ..... 236/92 B; 62/224; 251/23

[58] Field of Search ..... 236/92 B; 62/224; 251/63.4, 77, 23

[56] References Cited

U.S. PATENT DOCUMENTS

| | | | |
|---|---|---|---|
| 2,557,287 | 6/1951 | Hormann | 251/77 X |
| 2,579,334 | 12/1951 | Plank | 137/152.5 |
| 2,967,403 | 1/1961 | Lange et al. | 62/224 X |
| 3,034,534 | 5/1962 | Gustafsson | 137/781 |
| 3,699,778 | 10/1972 | Orth | 236/92 B X |
| 3,742,722 | 7/1973 | Leimbach | 62/224 X |
| 3,803,864 | 4/1974 | Cooper | 62/217 |

*Primary Examiner*—Albert J. Makay
*Assistant Examiner*—William E. Tapolcai, Jr.
*Attorney, Agent, or Firm*—Davis Chin

[57] ABSTRACT

A thermostatic expansion device for use in refrigeration systems includes a valve member adapted to control the flow of liquid refrigerant from a condenser to an evaporator of the refrigeration system. A pressure-responsive device is operatively connected to the valve member for responding to a differential pressure in the refrigeration system so as to open and close the valve member. A temperature-responsive device is operatively connected to the pressure-responsive device for responding to a temperature of the refrigerant at the outlet of the evaporator. A lead-lag compensation structure is connected to the pressure-responsive device for permitting a rapid movement of the valve member upon the occurrence of a sudden change either in the temperature of the refrigerant at the outlet of the evaporator or in the pressure at the inlet of the evaporator thereby maintaining a constant superheat at the outlet of the evaporator so as to effect stability of the refrigeration system.

7 Claims, 1 Drawing Figure

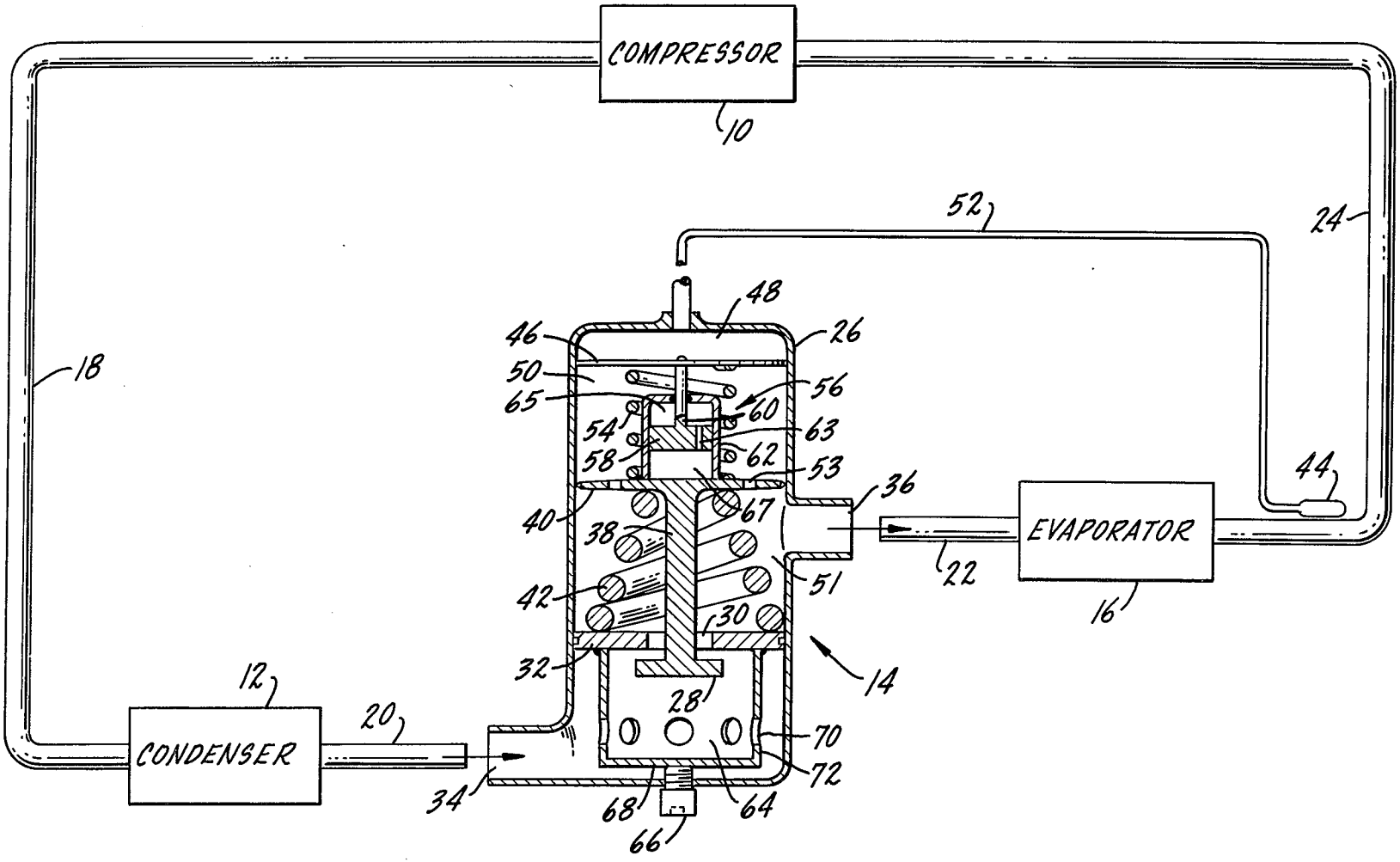
COMPRESSOR
10
EVAPORATOR
16
CONDENSER
12
14
18
20
22
24
26
28
30
32
34
36
38
40
42
44
46
48
50
51
52
53
54
56
58
60
62
63
64
65
66
67
68
70
72

THERMOSTATIC EXPANSION VALVE WITH LEAD-LAG COMPENSATION

BACKGROUND OF THE INVENTION

1. Field of the Invention

This invention relates generally to refrigerating apparatus and more particularly, it relates to refrigerant expansion valves for controlling the flow of liquid refrigerant from the condenser to the evaporator. The invention has particular applications in certain automotive air conditioning systems utilizing a constant displacement compressor.

2. Description of the Prior Art

In U.S. Pat. No. 3,803,864 issued to K. W. Cooper on Apr. 16, 1974 and assigned to the same assignee, there is disclosed an expansion device which includes a pair of springs acting against the opposite sides of a diaphragm for controlling the movement of a valve member.

In U.S. Pat. No. 3,034,534 to E. B. Gustafsson issued on May 15, 1962, there is disclosed an expansion valve which includes an externally controllable valve for regulating the pressure between a pair of chambers in order to suppress oscillations in the valve.

In U.S. Pat. No. 2,579,334 issued to N. Plank on Dec. 18, 1951, there is described a pressure-responsive flow regulator which includes a damping device consisting of a pair of flexible diaphragms disposed within a housing to form two pressure chambers on each side of the respective diaphragms. A spring cooperatively engages one of the diaphragms for actuating a valve member.

As is generally well-known in the art, a thermostatic expansion valve is commonly utilized in a refrigerating apparatus for maintaining a constant superheat of the gaseous vapor exiting the evaporator. However, a refrigerating apparatus which includes such a combination of an expansion valve and an evaporator is rarely in a stable condition as oscillation in the valve-evaporator control loop operation usually appear due to an excess of gain or phase in either the valve or the evaporator transfer function. Thus, it would be desirable to provide a thermostatic expansion valve having compensation means such as a mechanical lead-leg structure to compensate for any time delay in either the operation of a valve member or in the evaporator flow-to-superheat transfer relation. In view of this improved expansion valve construction, wide fluctuations or oscillations in the operation of the valve-evaporator control loop are prevented.

SUMMARY OF THE INVENTION

Accordingly, it is a general object of the present invention to provide a new and improved thermostatic expansion valve.

It is an object of the present invention to provide a thermostatic expansion valve having compensation means to maintain stability in a refrigeration system.

It is another object of the present invention to provide a thermostatic expansion valve having a mechanical lead-lag structure to compensate for any time delay in the operation of the expansion valve-evaporator control loop.

It is still another object of the present invention to provide a thermostatic expansion valve having a mechanical lead-lag compensation device formed of a dash-pot and a coil spring.

In accordance with these aims and objectives, the instant invention is concerned with the provision of a thermostatic expansion valve which includes a valve member adapted to control the flow of liquid refrigerant from a condenser to an evaporator of the refrigeration system. A pressure-reponsive device is operatively coupled to the valve member to respond to a differential pressure in the refrigeration system so as to open and close the valve member. A temperature-responsive device is operatively connected to the pressure-responsive device to respond to a temperature of the refrigerant at the outlet of the evaporator. A mechanical lead-lag compensation structure is connected to the pressure-responsive device to allow a rapid movement of the valve member upon the occurrence of a sudden change either in the temperature of the refrigerant at the outlet of the evaporator or in the pressure at the inlet of the evaporator so as to provide a constant superheat at the outlet of the evaporator to effect stability in the system.

BRIEF DESCRIPTION OF THE DRAWING

These and other objects and advantages of the present invention will become more fully apparent from the following detailed description when read in conjunction with the accompanying drawing in which there is shown a block diagram of the refrigerating apparatus including a cross-sectional view of a valve embodying the instant invention.

DETAILED DESCRIPTION OF THE PREFERRED EMBODIMENT

Referring now in detail to the drawing of the particular illustration, there is shown a refrigeration system of the present invention which includes a compressor 10, a condenser 12, a thermostatic expansion device 14 and an evaporator 16 all connected together in series to form a continuous, closed circuit. Refrigerant compressed by the compressor 10 is delivered to the condenser 12 through a line 18. The refrigerant is condensed to a liquid form in the condenser and is passed through a line 20 to the expansion device 14, which will be discussed more fully hereinafter. After the refrigerant passes through the expansion device, it flows via a line 22 to the evaporator 16 which cools the air or other fluid which is passed over the surfaces of the evaporator. The refrigerant then is returned through a suction line 24 to the inlet side of the compressor 10.

The expansion device 14 embodying the present invention includes a valve having a housing 26, a valve member 28 adapted to seat against an aperture 30 formed in annular flange 32 defining a valve seat, an inlet 34 and an outlet 36. The valve member 28 is connected to a valve stem 38 which is joined integrally at its opposite end to a valve diaphragm 40. A coil spring 42 is disposed between the lower side of the diaphragm 40 and the top sides of flange 32 and tends to exert a force for urging the valve member 28 toward a closed position against the lower sides of flange 32.

For sensing the suction line refrigeration temperature, temperature-responsive means such as a thermal-sensitive bulb 44 is mounted on the outlet of the evaporator 16 which responds to evaporator-outlet refrigerant temperature. A pressure-responsive means such as an actuating diaphragm 46 is arranged in the housing 26 to form separate chambers 48 and 50. The chamber 50 is in fluid communication with compartment 51 and the outlet 36 of the expansion valve via holes 53 in the valve diaphragm 40. The bulb 44 is in fluid communication with the chamber 48 in the upper portion of the housing 26 via a capillary tube 52. In order to apply stability to the refrigerating system due to an excess of gain or phase in either the valve or the evaporator transfer function, the expansion valve further includes a mechanical lead-lag compensation structure consisting of a coil spring 54 and a liquid-filled dash-pot 56.

The dash-pot 56 is formed of a damper piston 58 having a rod 60 and a fluid-filled cylinder 62. The end of the rod 60 opposite the piston 58 is attached to the lower side of the actuating diaphragm 46. The piston 58 reciprocates in the cylinder 62 in response to the movement of the diaphragm 46 caused by either a temperature change in the evaporator outlet as sensed by the bulb 44 or a pressure change in the inlet of evaporator 16 as sensed by the lower side of the diaphragm 46 via the outlet 36. The piston 58 contains an opening 63 which restricts the flow of the fluid between chambers 65 and 67 formed within the cylinder 62. The coil spring 54 is interposed between the lower side of the diaphragm 46 and the upper side of the diaphragm 40 in a surrounding relationship around the cylinder 62.

The distance between the valve member 28 to the aperture 30 defines the valve opening at any given superheat. This distance can be adjusted to the desired value by manually adjustable means such as a screw 66 joined integrally to a cylindrical-shaped member 68. Through movement of the screw 66, the valve opening superheat is defined. The upper end of the cylindrical-shaped member 68 is joined integrally to the lower sides of the flange 32. The member 68 contains also a plurality of holes 70 through which refrigerant flows from the inlet 34 to the outlet 36 via the aperture 30.

In normal steady-state operating conditions, the vapor pressure in the bulb 44, capillary tube 52 and the chamber 48 will be responsive to the temperature of the refrigerant at the outlet of the evaporator 16 and acts against the upper side of the actuating diaphragm 46 to cause the rod 60 and piston 58 to move within the cylinder 62. This results in a force being transferred to the upper side of the valve diaphragm 40 through the spring 54 which tends to bias the valve member 28 to its open position. The lower side of the diaphragm 40 has pressure applied to it by the two-phase refrigerant after expansion across the aperture 30. This pressure is communicated to the lower side of the diaphragm 46 through the holes 53 in the diaphragm 40. Dependent upon the differential pressures on the sides of the diaphragm 46 and the spring forces of springs 42 and 54, this will determine the position of the valve member 28 relative to the aperture 30.

In the event of a sudden or rapid displacement of the diaphragm 46 caused by either a rapid change in temperature as sensed by the bulb 44, or a rapid change in evaporator pressure at the outlet 36, the movement of the actuating diaphragm 46 is transferred via the diaphragm 40 to the valve member 28 since the damper piston 58 cannot be rapidly moved within the fluid-filled cylinder 62. Thus, a sudden increase in the evaporator superheat will open the valve allowing corresponding increase in the flow of refrigerant to the evaporator and a sudden decrease will close the valve to render the opposite result.

The coil spring 54 interposed between the diaphragms 40, 46 effects the slower movement of the damper piston 58 within the cylinder 62 in a direction corresponding to the temperature change at the outlet of the evaporator 16. It should be understood that the displacement of the valve diaphragm 40 and thus the valve member 28 will lead the displacement of the actuating diaphragm 46 so as to compensate for the phase lag caused by thermal delay in sensing the refrigerant temperature at the evaporator outlet thereby eliminating oscillations in the operation of the valve-evaporator control loop. The values of the spring constant of the coil springs 42, 54 and the damping coefficient of the dash-pot 56 are selected for the amount of phase compensation desired.

From the foregoing description of the expansion device embodying the present invention, it can be seen that there is provided a new and improved valve having a lead-lag phase compensation construction to thereby prevent oscillations in the operation of the expansion valve-evaporator control loop due to rapid changes either in the temperature of the refrigerant at the evaporator outlet or in the pressure at the evaporator inlet.

While there has been illustrated and described what is at present to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as a best mode contemplated for carrying out this invention, but that the invention will include all embodiments falling within the scope of the appended claims.

What is claimed is:

1. A thermostatic expansion device for use in refrigeration systems comprising:

valve means adapted to control the flow of liquid refrigerant from a condenser to an evaporator of the refrigeration system;

pressure-responsive means operatively connected to said valve means for responding to a differential pressure representative of refrigerant superheat changes at the outlet of said evaporator so as to open and close said valve means;

temperature-responsive means operatively connected to said pressure-responsive means for responding to a temperature of the refrigerant at the outlet of the evaporator; and lead-lag compensation means being further connected to said pressure-responsive means for permitting a rapid movement of said valve means upon the occurrence of a sudden change either in the temperature of the refrigerant at the outlet of the evaporator or in the pressure at the inlet of the evaporator thereby maintaining a constant superheat at the outlet of the evaporator so as to effect stability of the refrigeration system, said lead-lag compensation means including a dash-pot formed of a damper piston connected to a rod and a fluid-filled cylinder, and a coil spring disposed in a surrounding relationship around said cylinder.

2. A thermostatic expansion device as claimed in claim 1, wherein said temperature-responsive means comprises a thermal-sensitive bulb and said pressure-responsive means comprises an actuating diaphragm.

3. A thermostatic expansion device as claimed in claim 1, wherein said valve means comprises a valve member connected to one end of a valve stem, a valve seat and a coil spring.

4. A thermostatic expansion device as claimed in claim 3, further comprising a valve diaphragm connected to the end of said valve member opposite the valve stem.

5. A thermostatic expansion device as claimed in claim 4, wherein said valve diaphragm is provided with holes allowing fluid communication between said pressure-responsive means and the inlet of the evaporator.

6. A thermostatic expansion device as claimed in claim 1, further comprising means for adjusting the position of said valve means.

7. A thermostatic expansion device as claimed in claim 6, wherein said adjusting means comprises a screw joined integrally to a cylindrical-shaped member.

* * * * *